United States Patent [19]

Eckold et al.

[11] 4,400,966

[45] Aug. 30, 1983

[54] TOOL FOR FORMING A LATERAL OPENING IN A TUBE

[75] Inventors: Gerd-Jurgen Eckold, St. Andreasberg; Hans MaaB, Bad Lauterberg, both of Fed. Rep. of Germany

[73] Assignee: Walter Eckold GmbH & Co., St. Andreasberg Sperrluttertal, Fed. Rep. of Germany

[21] Appl. No.: 239,585

[22] Filed: Mar. 2, 1981

[30] Foreign Application Priority Data

Mar. 14, 1980 [DE] Fed. Rep. of Germany ..... 3009749

[51] Int. Cl.[3] ..... B21D 19/00

[52] U.S. Cl. ..... 72/392; 72/370; 29/157 T

[58] Field of Search ..... 72/367, 370, 377, 392, 72/482, 478, 393, 112, 115, 117, 120, 124, 125; 29/157 T

[56] References Cited

U.S. PATENT DOCUMENTS

| | | | |
|---|---|---|---|
| 311,960 | 2/1885 | Cottrell | 72/393 |
| 354,879 | 12/1886 | Youngs | 72/377 |
| 1,476,983 | 12/1923 | King | 72/478 |
| 1,680,650 | 8/1928 | Travis | 72/392 |
| 1,705,843 | 3/1929 | Walter | 72/392 |
| 1,823,047 | 9/1931 | Hothersall | 72/370 |
| 1,892,712 | 1/1933 | Taylor | 72/370 |
| 2,045,235 | 6/1936 | Newman | 72/117 |
| 2,461,565 | 2/1949 | Morrill | 72/393 |
| 2,991,674 | 7/1961 | Uhl | 72/393 |
| 3,060,994 | 10/1962 | Larsen et al. | 72/392 |
| 3,064,707 | 11/1962 | Walts | 29/157 T |
| 3,081,812 | 3/1963 | Brown | 72/124 |
| 3,468,147 | 9/1969 | Davies | 29/157 T |
| 3,564,897 | 2/1971 | Rickard | 72/393 |
| 3,817,071 | 6/1974 | Chalvignac | 72/120 |

FOREIGN PATENT DOCUMENTS

| | | | |
|---|---|---|---|
| 437789 | 5/1949 | Italy | 72/482 |
| 749794 | 5/1956 | United Kingdom | 72/370 |

*Primary Examiner*—Lowell A. Larson

*Attorney, Agent, or Firm*—Peterson, Palmatier, Sturm, Sjoquist & Baker, Ltd.

[57] ABSTRACT

A tool for forming a lateral opening in a tube comprises an assembly which can be inserted longitudinally into a tube until it lies opposite to an opening (12) through which an operating member (44) can be passed for operative engagement with the assembly at 46. The assembly includes a wedge member (16) with wedge surfaces (22) extending symmetrically in relation to the direction of motion of the operating member (44). Two spreader bodies (28,30) are mounted on the wedge member (16) and after initial insertion of the tool the operating member acts to displace the wedge member and hence the spreader body so that it contacts and deforms the interior of the pipe. Complete withdrawal of the tool through the opening (12) deforms the metal surrounding the opening and after a suitable finishing process another tube can be welded at right angles to the first mentioned tube to form a T-piece.

7 Claims, 4 Drawing Figures

TOOL FOR FORMING A LATERAL OPENING IN A TUBE

Figures 1A, 1B:
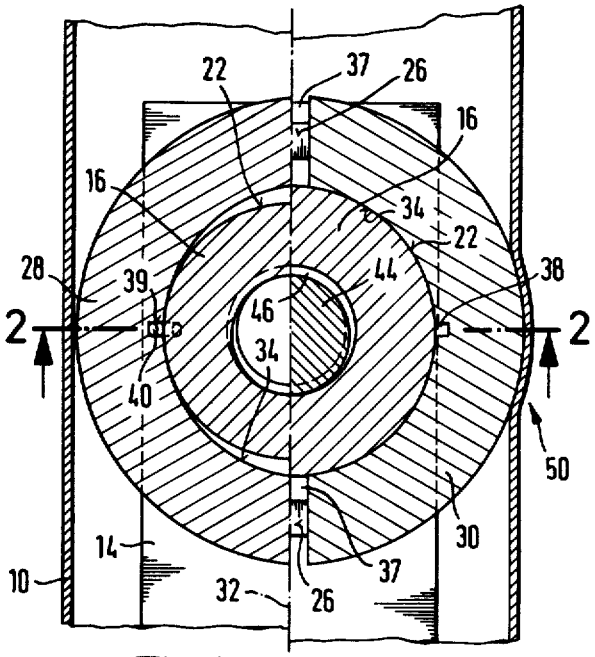

The invention relates to a tool for forming a lateral opening in a tube or pipe.

When a first tube is to be welded or soldered laterally to another tube, the first tube will be provided with an opening in its wall, which is complementary to an end face section of the tube to be secured, following which the contact line along the wall of the first tube is welded. A T-tube thus formed is unsightly, and the weld seam is difficult to lay down. In addition fluid flow conditions within the completed T-piece are changed adversely.

A solution which is functionally favourable and aids manufacture consists in that in the first tube a small opening is provided and a penetrating body is introduced along the tube until it lies opposite to the opening. From the outside an operating rod or other member is then coupled to the penetrating body, for example, screwed into it, and the penetrating body is then pulled through the small opening, so that the material surrounding the small opening is correspondingly plastically deformed to form an opening of larger size. The opening can then be finished so that after the deformation caused by the piercing action produced in this way it has a substantially plane end surface, to which the tube to be applied can easily be welded or soldered. Since the penetrating body must be capable of introduction longitudinally into the tube to be expanded, and the metal of the tube wall springs back after the pulling action of the penetrating body, it may be necessary to re-expand the opening, if there is to be applied a further tube of the same diameter as the first tube.

In order to avoid this disadvantage, a device has been provided, in which there is inserted from the outside through the opening a tool, which is then rotated and simultaneously withdrawn. Since in this way the tool does not need to have the contour of the expanded shape, the spring back of the tube material must be taken into account. This device which is marketed by the Company, Serlachius of Finland, is, however, relatively complicated and costly, and for this reason has only of limited application; in particular working operations on fixed interconnected tube networks of large diameter pipes can only be put into practice by disassembly of the corresponding tube sections.

According to the present invention there is provided a tool for forming a lateral opening in a tube or pipe, said tool comprising an assembly which can be inserted longitudinally of a tube until it lies opposite an opening through which an operating member can be passed for operative engagement with the assembly, said assembly including a wedge member with wedge surfaces extending symmetrically in relation to the direction of motion of the operating member, and sector shaped spreader bodies having opposing faces complementary to the wedge surfaces of the wedge member, the sectors being displaceable from a contracted initial configuration into an expanded working configuration along the wedge surfaces in which working configuration the tube wall is deformed outwardly, the tool then being ready for withdrawal by the operating member whereby to form the required lateral opening in the tube.

Further according to the present invention there is provided a tool for forming a lateral opening in a metal tube or pipe comprising first means defining a wedge surface and capable of receiving an operating member and second means defining at least two wedge surfaces complementary to the wedge surface of the first means, said operating member being capable, when the tool is inserted in a pipe and located at the position of the required lateral opening, of changing the configuration of the second means so that withdrawal of the operating member will produce an opening in the tube which is initially larger than the internal tube diameter to allow for spring back of the tube material in the opening substantially to the initial diameter of the tube.

Figures 2A, 2B:
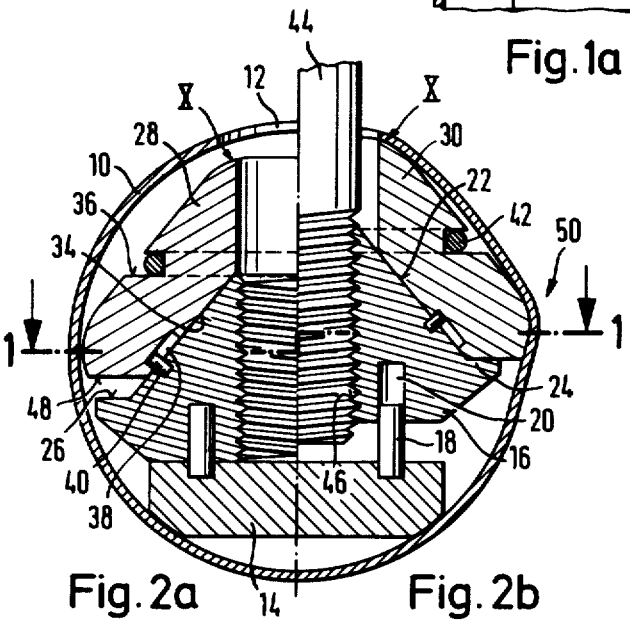

A tool for forming a lateral opening in a pipe or tube embodying the invention will now be described, by way of example, with reference to the accompanying diagrammatic drawing, in which:

FIG. 1 is a section through a tool in accordance with the invention on line 1—1 of FIG. 2, FIG. 1*a* showing the configuration on insertion of the tool in a pipe and FIG. 1*b* showing the tool in its expanded configuration; and FIG. 2 is a section on the line 2—2 of FIG. 1, FIG. 2*a* being intended to be considered in conjunction with FIG. 1*a*, and FIG. 2*b* being intended to be considered in conjunction with FIG. 1*b*.

Referring to the drawing, the tube 10 to be provided with a lateral opening can be seen together with an opening 12 for an actuating rod. The Figures denoted by "a" indicate the configuration of the tool parts immediately after introduction into the tube 10.

A wedge-action member 16 is mounted on a bar 14 for introducing the tool to the pipe, for example with the aid of permanent magnets (not shown). The bar 14 has cooperating means for securing the wedge member against rotation in the form of the two pegs 18 carried in bores in the bar 14, which pegs also engage in blind bores 20 of the wedge member 16. As is apparent in FIG. 2*b*, the wedge member 16 can be at least partially withdrawn from the pegs. The location, in general, does not need to be particularly accurate.

The wedge member has a circular conical surface 22 acting as an operative wedge surface and near the base thereof an annular ridge 24 with an abutment is provided having support face 26 directed away from the bar 14.

An operative spreader body comprises two similar sectors 28 and 30. Also the remaining elements of the tool are symmetrical in relation to the centre plane 32 of the tube, so that the "a" Figures show the sector 28 and the "b" Figures show the sector 30; other configuration of the sectors of the spreader body would similarly be mirror symmetrical about the plane 32.

For the manufacture of the spreader body 28,30 initially a blank is turned with an inner conical surface 34, which is complementary to the conical surface 22 of the wedge member 16; the body 28,30 has an outer contour, which is, in the embodiment by way of example, generally pear-shaped. The precise locus of the outer contour will be determined from the deformation requirements; two dimensions are, however, of some importance namely the largest diameter of the blank, which is somewhat larger than the diameter of the tube 10 (the precise oversize is determined according to the material specification of the tube and its wall thickness), and the other dimension is the distance between the centre of the radial plane of this largest diameter and the peripheral line, which is indicated in FIG. 2*b* by "X". In addition the blank is formed with a peripheral groove 36. The blank is then, in the embodiment described, cut through along a surface line of the inner conical surface 34, so that a saw cut 37 is produced, of which one half of the width is apparent in FIG. 1*b*. In the thus exposed inner conical surfaces small recesses 38 are machined; the wedge member carries pins 40 opposite to these recesses and perpendicular to the conical surfaces.

The sectors 28,30 are then so mounted on the wedge member, that the pins 40 engage in the recesses 38, so that the ingernal conical surfaces 34 lie on the conical outer surface of the wedge member with surface-to-surface contact. A spring ring (circlip) 42 is engaged in the peripheral groove 36 which biases the sectors 28,30 towards one another. The sectors therefore slide along the conical surfaces on the wedge member upwardly and, indeed, to a configuration where the saw cut 36 is closed up. The dimensions are so selected that in the insertion position the tool as a whole can be readily inserted into the tube; the pins 40 thus have the function of establishing the location of the sectors 28,30 relative to the bar 14 and simultaneously to connect the wedge member and the sectors non-releasably after application of the spring ring 42.

It is apparent in FIG. 1*a* that in the introduction configuration the sector 28 (and 30) only makes contact along a surface line of the wedge member. It is also possible to construct the wedge member and the sectors with plane wedge surfaces, as a result of which the surface-to-surface contact remains in the contracted introduction condition of the spreader body. Since, however, the loading in the zone of the wedge surfaces is initially fully established, when the working position according to FIGS. 1*b*, 2*b* is attained, no excessive surface pressure can arise even with this simple construction.

After the introduction of the bar 14 with the wedge member 16 and spreader body 28, 30 below the opening 12 in the tube the operating rod 44 is introduced from the outside and screwed into the tapped bore 46 of the wedge member. Instead of this screwed connection a bayonet connection or the like can alternatively be provided. The outside the tube 10 can be supported by means of a shaped member (not shown), which, however, naturally must permit the free passage of the tool. The actuating rod 44 is now drawn outwardly, for example by means of a hydraulic cylinder; alternatively, the rod can be fixed axially and driven in rotation, so that the wedge member is moved along the operating rod in the manner of a spindle nut. The sectors 28,30 also take part in the radial movement of the wedge member 16, until they encounter the peripheral line "X" in the region of the tube inner wall. Thereby the sectors are pressed downwardly, as a result of which they are simultaneously also pressed outwardly, until their end surfaces 48 opposite to the bar 14 engaged on the abutment and support surface 26. In this way there is effected at 50 an initial widening of the tube 10 so that the final withdrawal will cause an opening to be formed which is of adequate size even after spring back. With the progress of the wedge member movement the sectors are now also moved along and effect the desired extension.

By means of the tool hereinbefore described it is possible to make a hole in a tube wall which is equal to or larger than the diameter of a tube to be welded or soldered thereto to form a T-piece. The excess size will be calculated to accommodate spring back.

In contrast to previously proposed tools, the tool hereinbefore described has two different overall dimensions, namely a smaller dimension, when it is contracted and is insertable into the tube, for which it is desirable to use an insertion bar, and a larger dimension, which the tool assumes progressively during the expansion of its sectors, as a result of which also the expansion of the tube is initiated.

The division of the expander body 28,30 into sectors can be effected in the simplest case parallel to the withdrawal direction during the expansion; during the expansion a gap naturally arises between the previously adjacent sectors, which also makes itself apparent in the end surface portion of the deformed metal as small inwardly extending lips. This can easily be overcome; it is possible to make the sector division skewed to the direction of withdrawal and thereby this disadvantage is overcome.

We claim:

1. A tool for forming a lateral opening in a tube or pipe at a location determined by an aperture of lesser diameter in a sidewall thereof, comprising, in combination;

an elongated body member sized and adapted to be adjustably, longitudinally disposed internally and adjacent to such aperture in the sidewall of the tube;

a wedge member laterally movably disposed on said body member for adjustable disposition laterally outwardly of said tube, said wedge member including means for cooperative engagement with a means for moving said wedge member laterally outwardly of the tube at said aperture and having wedge surfaces symmetrical to the direction of movement thereof;

and a plurality of sector shaped spreader bodies to move with the wedge member laterally outwardly of the tube and to spread from each other transversely of said laterally outward movement, the spreader bodies having internal wedging surfaces in sliding, cooperative disposition on the wedging surfaces of said wedge member to be spread thereby, the spreader bodies having outer arcuate forming surfaces with peripheral portions facing transversely of the laterally outward movement of the wedge member and configured to engage, displace and distend the tube sidewall circumferentially of the aperture in the tube, said forming surfaces also having rounded abutting surface portions facing endways of the laterally outward movement of the wedge member and configured to abut the inner periphery of the tube sidewall adjacent the aperture therein as the wedge member is moved laterally outwardly to cause spreading of the spreader bodies from a retracted position whereat the diameter of said peripheral surface portions is less than the diameter of said tube, to an extended position whereat the diameter of said peripheral surface portions, is greater than the diameter of said tube, whereby to distensibly form the tube sidewall around the aperture and produce such a lateral opening in the tube as the wedge member is moved laterally outwardly of the tube.

2. The apparatus of claim 1 in which the wedge member includes a laterally outwardly extending support surface facing the sector shaped spreader bodies to engage the spreader bodies when in the extended position to thereby determine the diameter of the peripheral portions of said outer surfaces of said spreader bodies.

3. The apparatus of claim 1 in which biasing means are disposed intermediate the spreader bodies whereby the sectors of the spreader body are biased toward one another.

4. The apparatus of claim 1 in which the spreader bodies are comprised of two sectors.

5. The apparatus of claim 1 in which the wedge surfaces of the wedge member and the internal wedging surfaces on the spreader bodies are of complementary conical configuration.

6. The apparatus of claim 5 in which the spreader bodies and the wedge member are rotationally symmetrical and a means for preventing relative rotational motion is disposed intermediate said wedge member and said spreader bodies.

7. The apparatus of claim 6 in which the wedge member is non-rotatably disposed on the body member.

* * * * *